US012078449B1

(12) United States Patent
Menard

(10) Patent No.: US 12,078,449 B1
(45) Date of Patent: Sep. 3, 2024

(54) ADJUSTABLE SHOOTING STRAP

(71) Applicant: Shawn Menard, Holt, MI (US)

(72) Inventor: Shawn Menard, Holt, MI (US)

( * ) Notice: Subject to any disclaimer, the term of this patent is extended or adjusted under 35 U.S.C. 154(b) by 193 days.

(21) Appl. No.: 17/941,520

(22) Filed: Sep. 9, 2022

(51) Int. Cl.
*F41C 33/00* (2006.01)

(52) U.S. Cl.
CPC ..... *F41C 33/001* (2013.01)

(58) Field of Classification Search
CPC ..... F41C 33/001; F41C 33/002
See application file for complete search history.

(56) References Cited

U.S. PATENT DOCUMENTS 5,643,184 A 7/1997 Toso
6,543,096 B2 * 4/2003 Settelmayer ..... A44B 11/12 24/170
7,959,046 B2 * 6/2011 Burnsed, Jr. ..... F41C 33/001 224/150
9,052,156 B2 * 6/2015 Nevils ..... F41C 33/001
9,291,425 B2 * 3/2016 Golob ..... F41C 33/001
9,587,908 B2 * 3/2017 Bjelde ..... F41C 33/007
9,746,284 B2 * 8/2017 McCarthy ..... F41C 33/002
2014/0263489 A1 * 9/2014 Hendricks ..... F41C 33/002 29/401.1

FOREIGN PATENT DOCUMENTS

KR 102180391 B1 * 11/2020

* cited by examiner

*Primary Examiner* — Scott T McNurlen
(74) *Attorney, Agent, or Firm* — Donald J. Ersler

(57) ABSTRACT

An adjustable shooting strap preferably includes a weapon interface section, a strap section and a carabiner strap section. The weapon interface section preferably includes a weapon strap, a first interchangeable weapon interface, a first buckle, a second buckle and a male connection buckle. The strap section preferably includes a lengthwise strap, a female detachable buckle and a cam buckle. A hand loop is created in the lengthwise strap for fine adjustment. The female detachable buckle is sized to receive the male connection buckle. The male connection buckle is retained on a first end of the lengthwise strap. The cam buckle is retained on a second end of the lengthwise strap. The carabiner strap section preferably includes a carabiner, a carabiner strap and a second weapon interface. The adjustable shooting strap may be used in many different shooting positions, such as standing kneeling, or sitting.

10 Claims, 15 Drawing Sheets

ADJUSTABLE SHOOTING STRAP

BACKGROUND OF THE INVENTION

1. Field of the Invention

The present invention relates generally to firearms and more specifically to an adjustable shooting strap, which allows a shooter to quickly stabilize a firearm in nearly any shooting position.

2. Discussion of the Prior Art

The prior art discloses numerous shooting straps, some of which rely on engaging one arm of the shooter. U.S. Pat. No. 5,643,184 to Toso discloses a back support knee and foot engaging straps.

Accordingly, there is a clearly felt need in the art for an adjustable shooting strap, which allows a shooter to quickly stabilize in nearly any shooting position with a firearm, such as a rifle or machine gun by providing an additional vector of tension to the firearm.

SUMMARY OF THE INVENTION

The present invention provides an adjustable shooting strap, which allows a shooter to quickly stabilize a firearm in nearly any shooting position. The adjustable shooting strap preferably includes a weapon interface section, a strap section and a carabiner strap section. The weapon interface section preferably includes a weapon strap, a first interchangeable weapon interface, a first buckle, a second buckle and a male connection buckle. A first end of the weapon strap is inserted through a loop in the first interchangeable weapon interface and folded over to form a first belt loop. The first belt loop is maintained with the first buckle. A first weapon leg and a second weapon leg are created by the first loop from the weapon strap. An end of the second weapon leg is inserted through the second buckle and through the male connection buckle. The end of the second weapon leg is folded over and sewn to itself to form a second belt loop to retain the male connection buckle. An end of the first weapon leg is inserted through the second buckle and through the male connection buckle, both above the second weapon leg strap.

The strap section preferably includes a lengthwise strap, a female detachable buckle and a fine adjustment buckle. The fine adjustment buckle includes a first end bar, a middle fine bar and a second end bar. A first end of the lengthwise strap is inserted through a first space between the middle fine bar and the first end bar; a second space between the middle fine bar and the second end bar; and a loop in the female detachable buckle. The fine adjustment buckle is spaced apart from the fine adjustment buckle, before insertion of the lengthwise strap.

The first end of the lengthwise strap is inserted through the first space and folded over itself around the first end bar; and sewn to itself to create a third belt loop. A length of the lengthwise strap is looped to create a hand loop. The first end of the lengthwise strap is inserted through the second space and sewn to itself on both sides of the second end bar to create a fourth belt loop. The female detachable buckle is sized to receive the male connection buckle. The hand loop allows a hand to fine adjust a length of the lengthwise strap to create tension in the lengthwise strap.

A second end of the lengthwise strap is retained in a cam buckle. The cam buckle includes a first cam loop, a second cam loop and a spring-loaded retainer. The second end of the lengthwise strap is inserted through the second cam loop, the first cam loop and the spring-loaded retainer. Adjusting a length of the lengthwise strap is done by pulling the spring-loaded retainer upward to release an axial location of the lengthwise strap relative to the spring-loaded retainer. An excess length of the second end of the lengthwise strap is preferably retained in a Velcro bundle or a strap manager. The spring-loaded retainer of the cam buckle acts a gross adjuster for removing slack from the lengthwise strap.

The carabiner strap section preferably includes a carabiner, a carabiner strap, a second weapon interface and a second weapon buckle. One end of the carabiner strap is wrapped around carabiner and attached to itself to form a permanent loop. A second end of the carabiner strap is inserted through the second cam loop. A portion of the carabiner strap is attached to itself to form a permanent loop around the second cam loop. The second end of the carabiner strap is further inserted through the second weapon buckle and a loop of the second weapon interface. The second end of the carabiner strap is looped around the loop of the second weapon interface and inserted through second weapon buckle. The second weapon buckle allows lengthwise adjustment of the second weapon interface relative to the lengthwise strap.

The adjustable shooting strap is suitable for use in a prone position application; a tripod application with adjustable shooting strap attached to waist; tripod application with standing gas pedal technique; tripod application with adjustable shooting strap attached to waist while seated or kneeling; tripod application with seated gas pedal technique; fence or railing application; overhead suspension application; and applications for tradition alternative shooting positions.

The prone position application includes connecting the carabiner to a belt; connecting the first interchangeable weapon interface to a front of a firearm; pulling slack out of the lengthwise strap with the gross adjuster; and using the fine adjuster.

The tripod application with adjustable shooting strap attached to waist includes connecting the carabiner to a belt; connecting the first interchangeable weapon interface to a front of a firearm; passing the female connection buckle under the firearm; connecting the male connection buckle to the female connection buckle; pulling slack out of the lengthwise strap with the gross adjuster; and using the fine adjuster.

The tripod application with standing gas pedal technique includes connecting the carabiner to a belt; connecting the first interchangeable weapon interface to a front of a firearm; attaching the firearm to a tripod; passing the female connection buckle under the firearm; connecting the male connection buckle to the female connection buckle; removing slack from the lengthwise strap, such that it just touches the ground with the gross adjuster; create a loop; insert a foot through the loop and use the fine adjuster.

The tripod application with adjustable shooting strap attached to waist while seated or kneeling includes connecting the carabiner to a belt; connecting the first interchangeable weapon interface to a front of a firearm; attaching the firearm to a tripod; passing the female connection buckle under the firearm; connecting the male connection buckle to the female connection buckle; while sitting or kneeling remove slack from the lengthwise strap; use the fine adjuster; grasp the tripod with a non-firing hand and drop hips back to pull the firearm down to the tripod.

The tripod application with seated gas pedal technique includes connecting the carabiner to a belt; connecting the first interchangeable weapon interface to a front of a firearm; passing the female connection buckle under the firearm; connecting the male connection buckle to the female connection buckle; removing slack from the lengthwise strap, such that it just touches the ground with the gross adjuster; use gross and fine adjusters, such that the foot is about 1.5 to 2.0 inches off the ground; adjust the rifle to the target; drive the toe of a support foot down; placing tension on the loop; and drawing the firearm down tightly.

The fence or railing application includes connecting the carabiner to a belt; looping the lengthwise strap around a fence or railing; connecting the first interchangeable weapon interface to a front of a firearm; pulling slack out of the lengthwise strap with the gross adjuster; and using the fine adjuster.

The overhead suspension application includes wrapping the lengthwise strap around an overhead object; connecting the first interchangeable weapon interface to a portion of the firearm; connecting the carabiner to the lengthwise strap; pulling slack out of the lengthwise strap with the gross adjuster; and using the fine adjuster.

The adjustable shooting strap may be used in other tradition alternative shooting positions, such as standing kneeling at sitting.

Accordingly, it is an object of the present invention to provide an adjustable shooting strap, which allows a shooter to quickly stabilize a firearm in nearly any shooting position.

It is another object of the present invention to provide an adjustable shooting strap, which reduces recoil.

It is a further object of the present invention to provide an adjustable shooting strap, which provides faster follow-through and reduced shot-to-shot recovery time.

It is yet a further object of the present invention to provide an adjustable shooting strap, which provides rapid deployment and emergency bail-out capability.

Finally, it is another object of the present invention to provide an adjustable shooting strap, which may be used in Military/LE Sniping, Long Range Hunting, Precision Rifle Competition, Infantry Machine Gun Applications and in any other suitable application.

These and additional objects, advantages, features and benefits of the present invention will become apparent from the following specification.

DETAILED DESCRIPTION OF THE PREFERRED EMBODIMENTS

Figure 1:
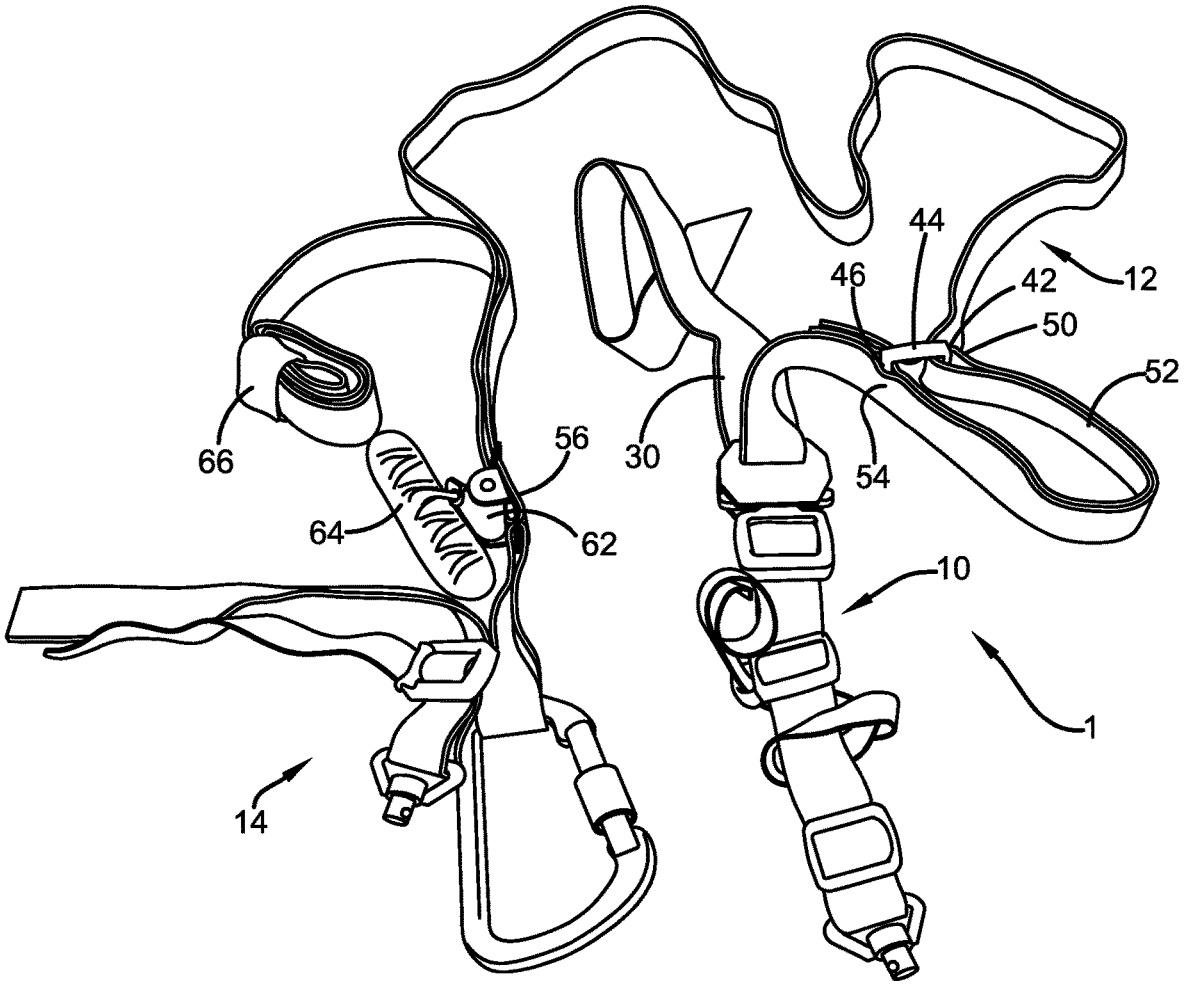
FIG. 1 is a perspective view of an adjustable shooting strap in accordance with the present invention.
Figure 2:
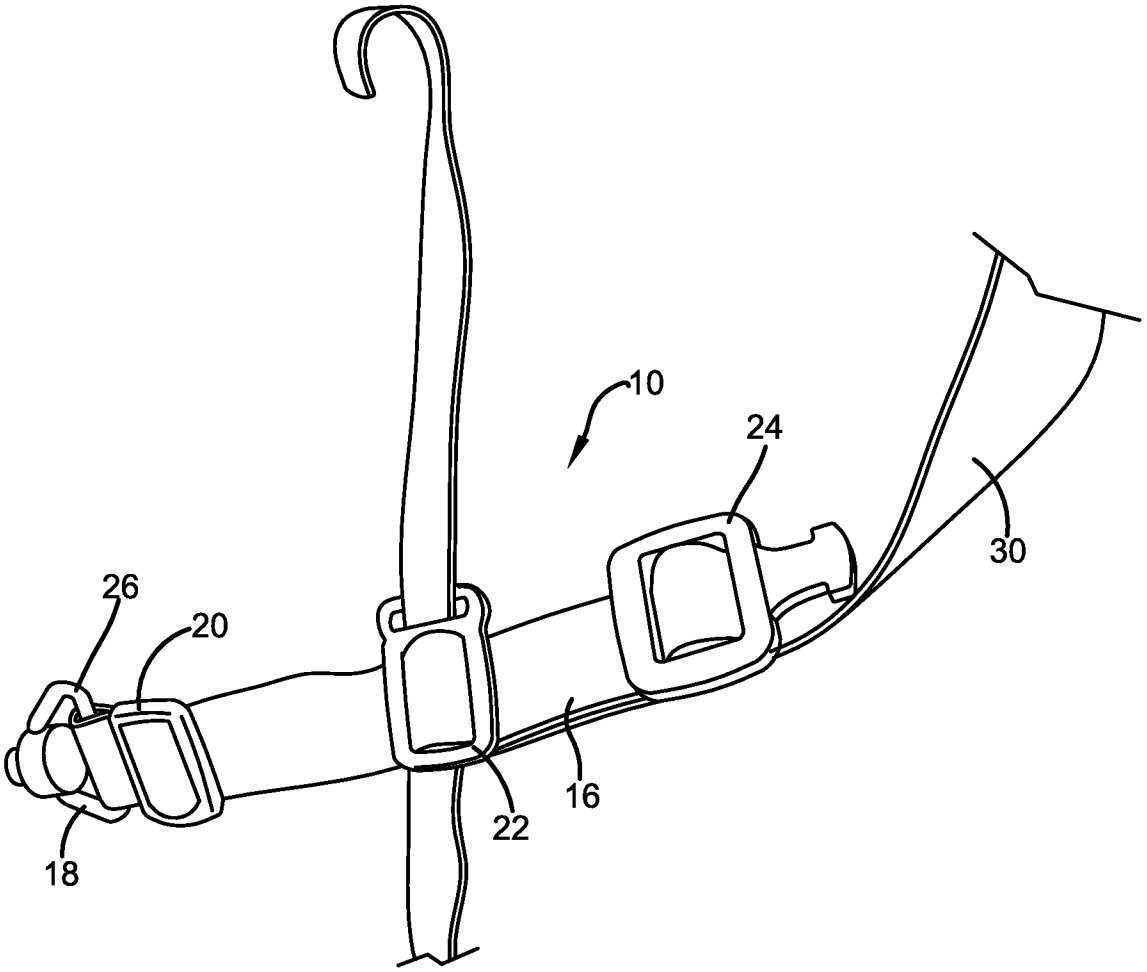
FIG. 2 is a perspective top view of a weapon interface section of an adjustable shooting strap in accordance with the present invention.
Figure 3:
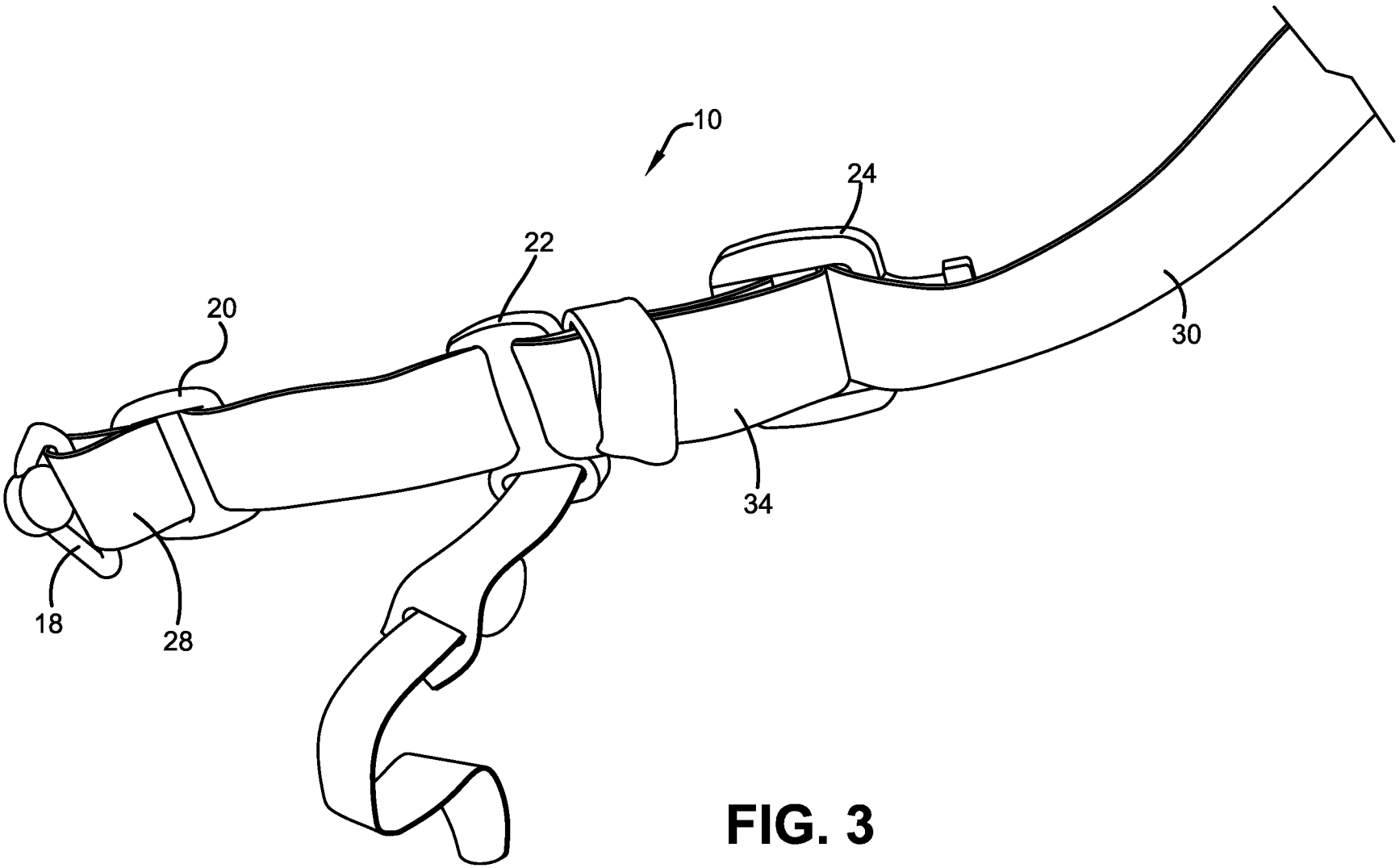
FIG. 3 is a perspective bottom view of a weapon interface section of an adjustable shooting strap in accordance with the present invention.
Figure 4:
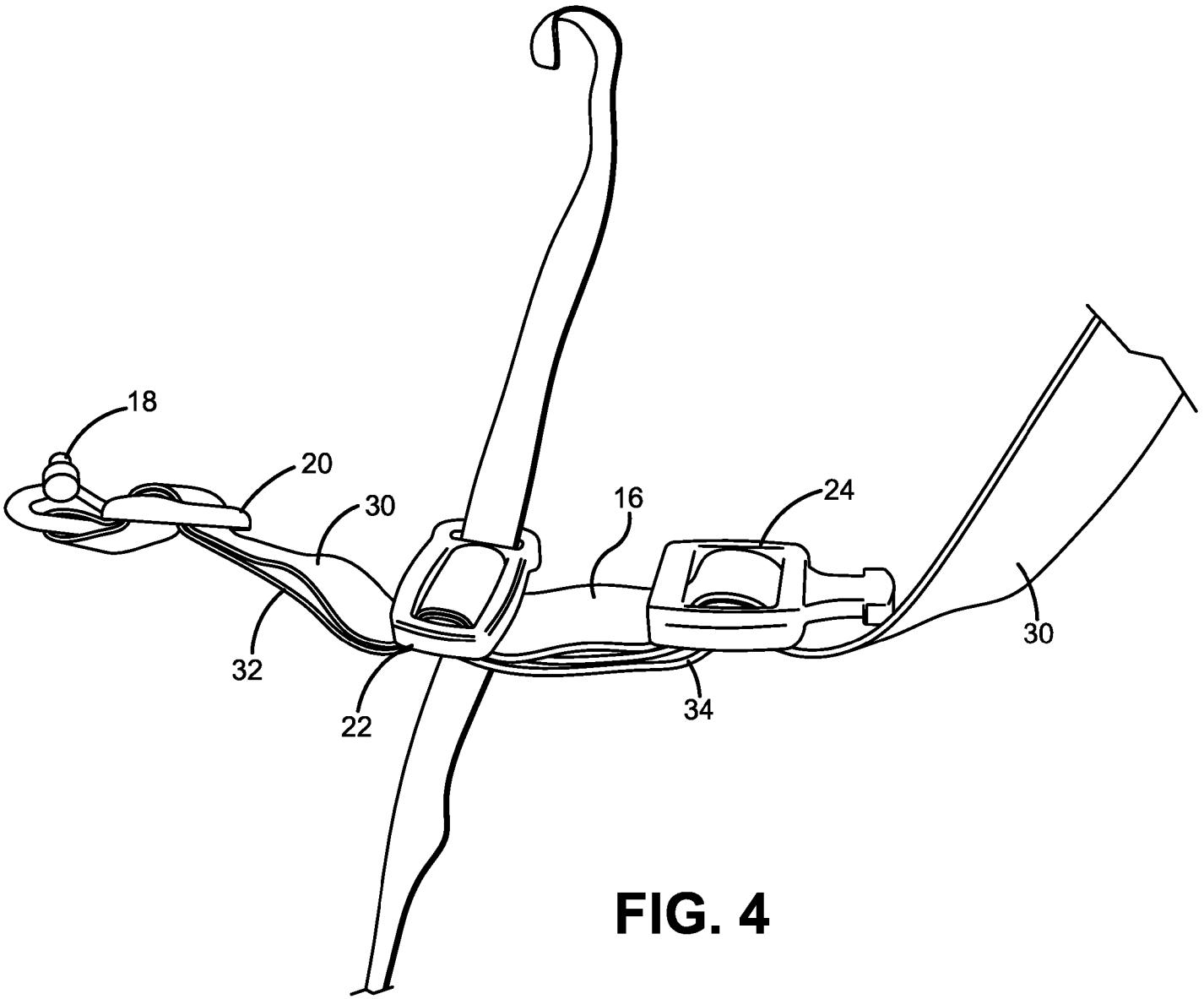
FIG. 4 is a perspective end view of a weapon interface section of an adjustable shooting strap in accordance with the present invention.

With reference now to the drawings, and particularly to FIG. 1, there is shown an adjustable shooting strap 1. With reference to FIGS. 2-4, the adjustable shooting strap 1 preferably includes a weapon interface section 10, a strap section 12 and a carabiner strap section 14. The weapon interface section 10 preferably includes a weapon strap 16, a first interchangeable weapon interface 18, a first buckle 20, a second buckle 22 and a male connection buckle 24. A first end of the weapon strap 16 is inserted through a loop 26 in the first interchangeable weapon interface 18 and folded over to form a first belt loop 28. The first belt loop 28 is maintained with the first buckle 20. A first weapon leg 30 and a second weapon leg 32 are created by the first loop 28 from the weapon strap 16. An end of the second weapon leg 32 is inserted through the second buckle 22 and through the male connection buckle 24. The end of the second weapon leg 32 is folded over and sewn to itself to form a second belt loop 34 to retain the male connection buckle 24. An end of the first weapon leg 30 is inserted through the second buckle 22 and through the male connection buckle 24, both above the second weapon leg 32 strap.

Figure 5:
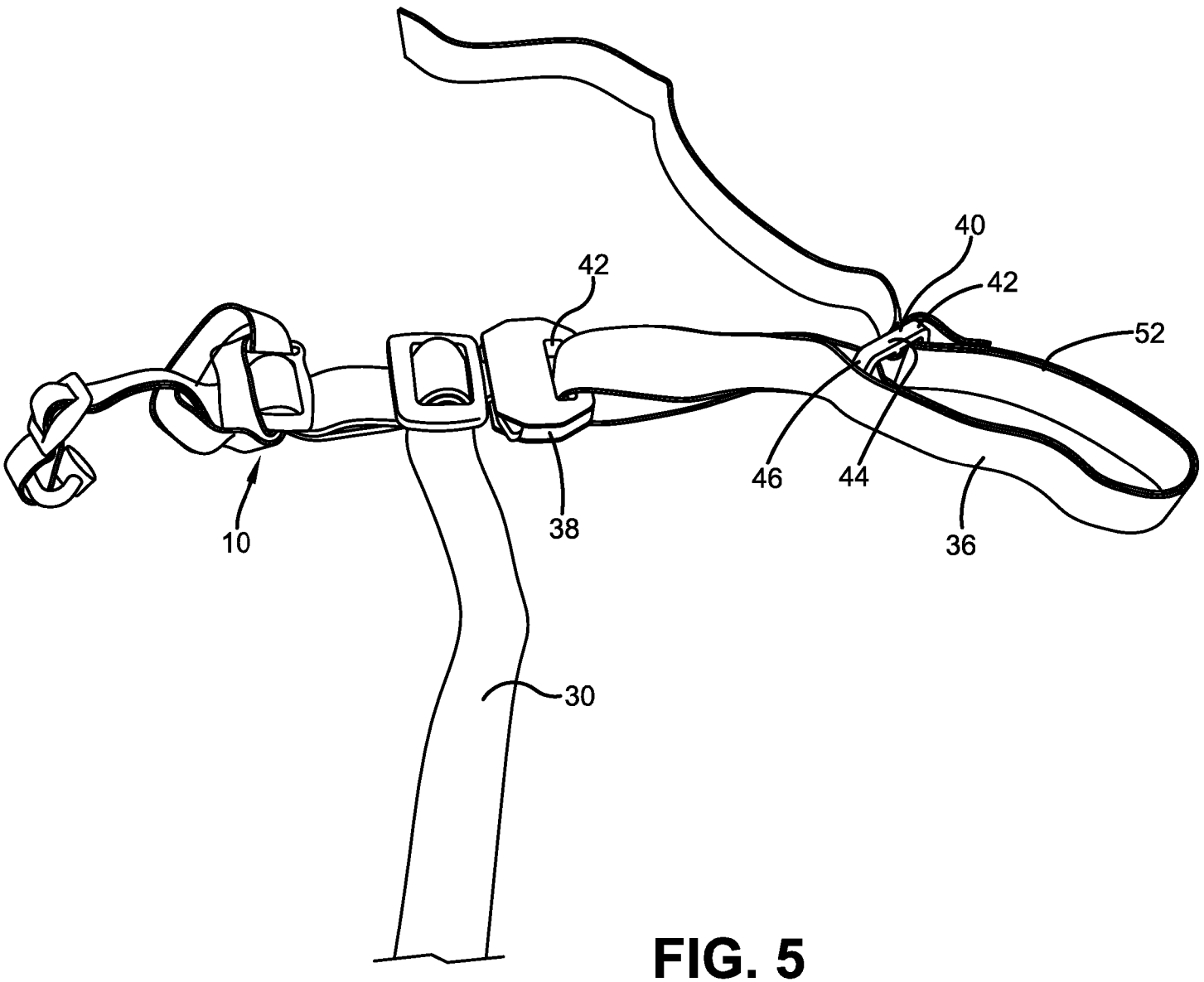
FIG. 5 is a perspective top view of a weapon interface section secured to a female connection buckle of a lengthwise strap in accordance with the present invention.
Figure 6:
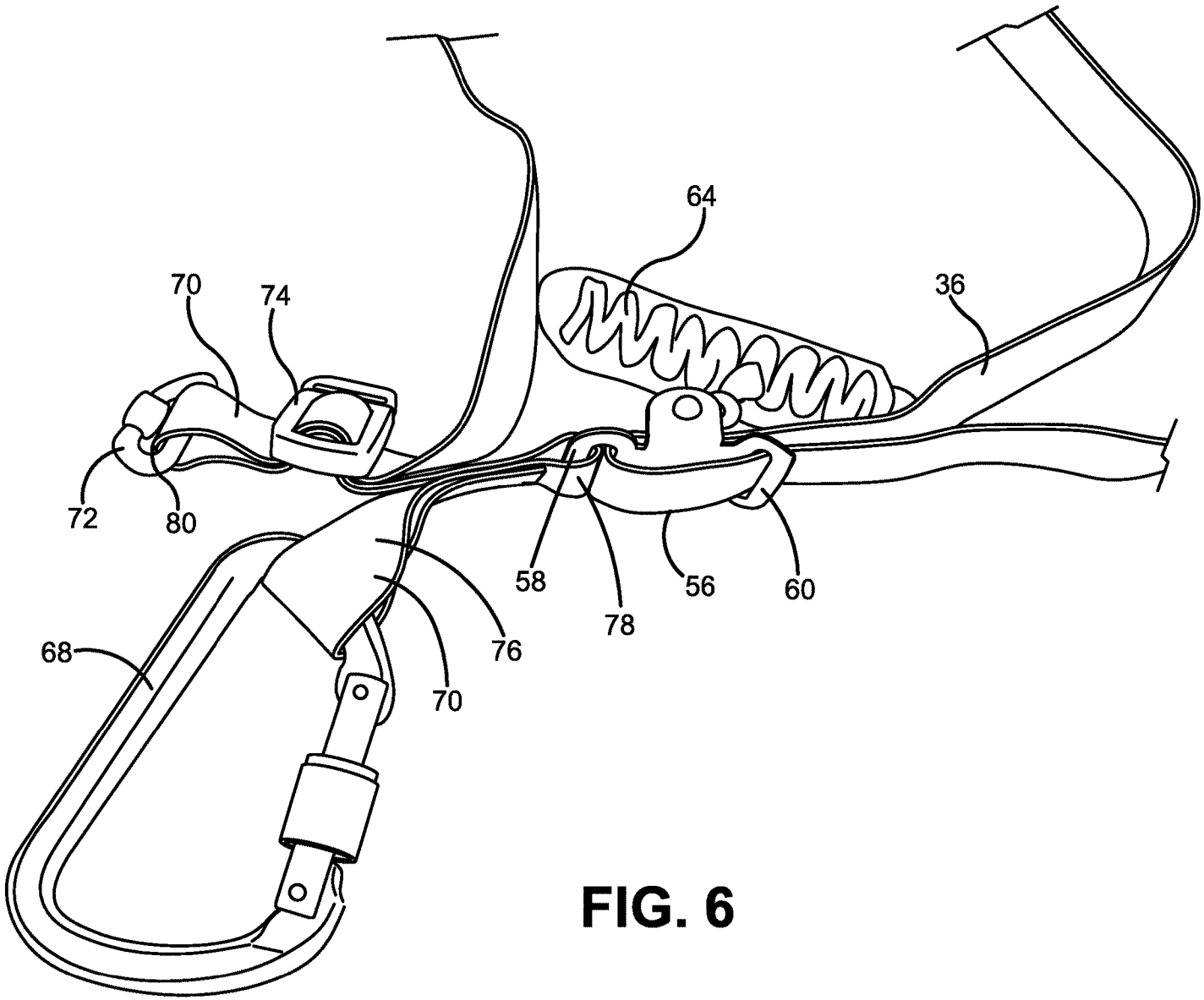
FIG. 6 is a perspective top view of a carabiner strap section an adjustable shooting strap in accordance with the present invention.

With reference to FIGS. 1 and 5-6, the strap section 12 preferably includes a lengthwise strap 36, a female detachable buckle 38 and a fine adjustment buckle 40. The fine adjustment buckle 40 includes a first end bar 42, a middle fine bar 44 and a second end bar 46. A first end of the lengthwise strap 36 is inserted through a first space between the middle fine bar 44 and the first end bar 42; a second space between the middle fine bar 44; and the second end bar 46 and a loop 42 in the female detachable buckle 38. The fine adjustment buckle 40 is spaced apart from the fine adjustment buckle 40, before insertion of the lengthwise strap 36. The first end of the lengthwise strap 36 is inserted through the first space and folded over itself around the first end bar 42; and sewn to itself to create a third belt loop 50. A length of the lengthwise strap 36 is looped to create a hand loop 52. The first end of the lengthwise strap 36 is inserted through the second space and sewn to itself on both sides of the second end bar 46 to create a fourth belt loop 54. The female detachable buckle 38 is sized to receive the male connection buckle 24. The hand loop 52 allows a hand to fine adjust a length of the lengthwise strap 36 to create tension in the lengthwise strap 36.

With reference to FIG. 6, a second end of the lengthwise strap 36 is retained in a cam buckle (adjustment buckle) 56. The cam buckle 56 includes a first cam loop 58, a second cam loop 60 and a spring-loaded retainer 62. The second end of the lengthwise strap 36 is inserted through the second cam loop 60, the first cam loop 58 and through the spring-loaded retainer 62. Adjusting a length of the lengthwise strap 36 is done by pulling the spring-loaded retainer 62 upward and pulling the lengthwise strap 36 in either direction to change an axial location of the lengthwise strap 36 relative to the cam buckle 36. A handle 64 may be extended from the spring-loaded retainer 62 to facilitate adjustment of the lengthwise strap 36. An excess length of the second end of the lengthwise strap 36 is preferably retained in a Velcro bundle or strap manager 66. The spring-loaded retainer 62 of the cam buckle 56 acts a gross adjuster for removing slack from the lengthwise strap 36.

With reference to FIGS. 1 and 6, the carabiner strap section 14 preferably includes a carabiner 68, a carabiner strap 70, a second weapon interface 72 and a second weapon buckle 74. One end of the carabiner strap 70 is wrapped around the carabiner 68 and attached to itself to form a permanent loop 76. A second end of the carabiner strap 70 is inserted through the first cam loop 58. A portion of the carabiner strap 70 is attached to itself to form a permanent loop 78 around the first cam loop 58. The second end of the carabiner strap 70 is also inserted through the second weapon buckle 74 and a loop 80 of the second weapon interface 72. The second end of the carabiner strap 70 is finally looped around the loop 80 of the second weapon interface and re-inserted through second weapon buckle 74. The second weapon buckle 74 allows lengthwise adjustment of the second weapon interface 72 relative to the lengthwise strap 36.

With reference to FIGS. 7-17, the adjustable shooting strap 1 is suitable for use in a prone position application; a tripod application with adjustable shooting strap attached to waist; tripod application with standing gas pedal technique; tripod application with adjustable shooting strap attached to waist while seated or kneeling; tripod application with seated gas pedal technique; fence or railing application; overhead suspension application; and applications for tradition alternative shooting positions.

Figure 7:
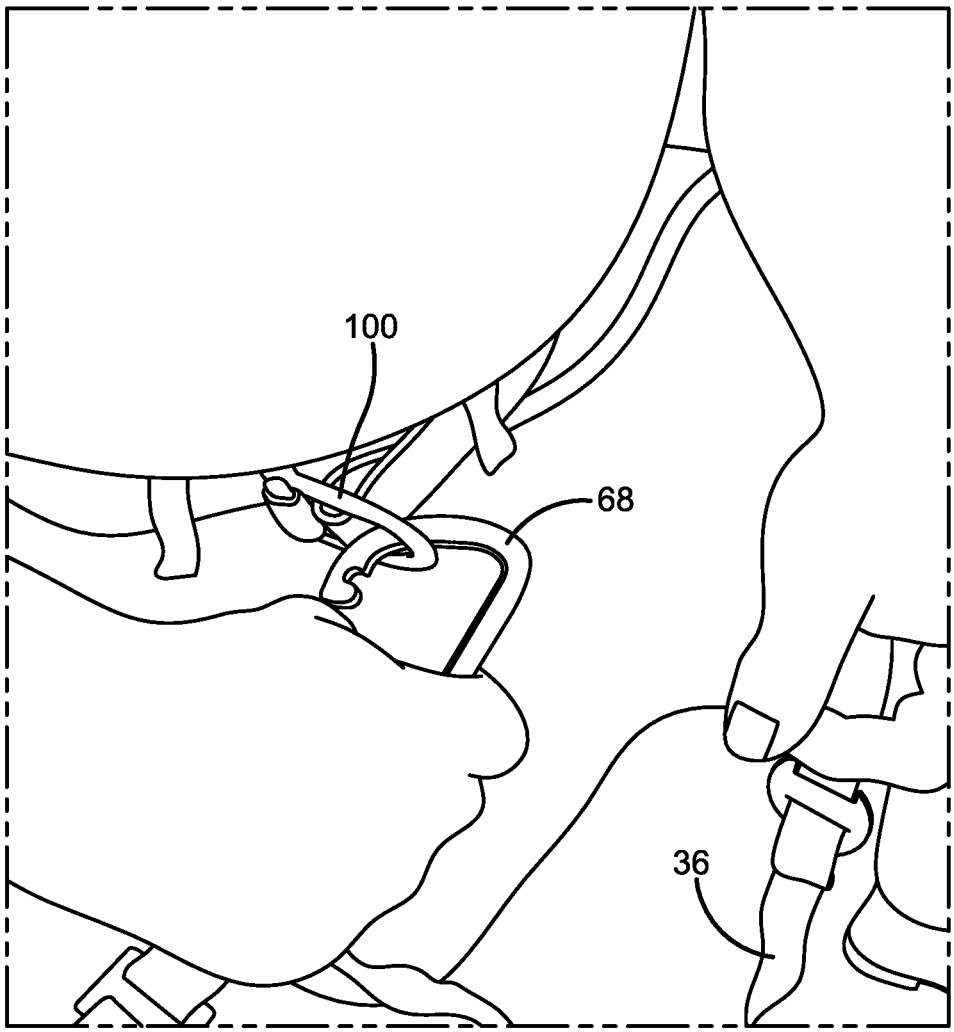
FIG. 7 is a perspective view of a carabiner of a shooting strap being attached to a belt of a user in accordance with the present invention.
Figure 8:
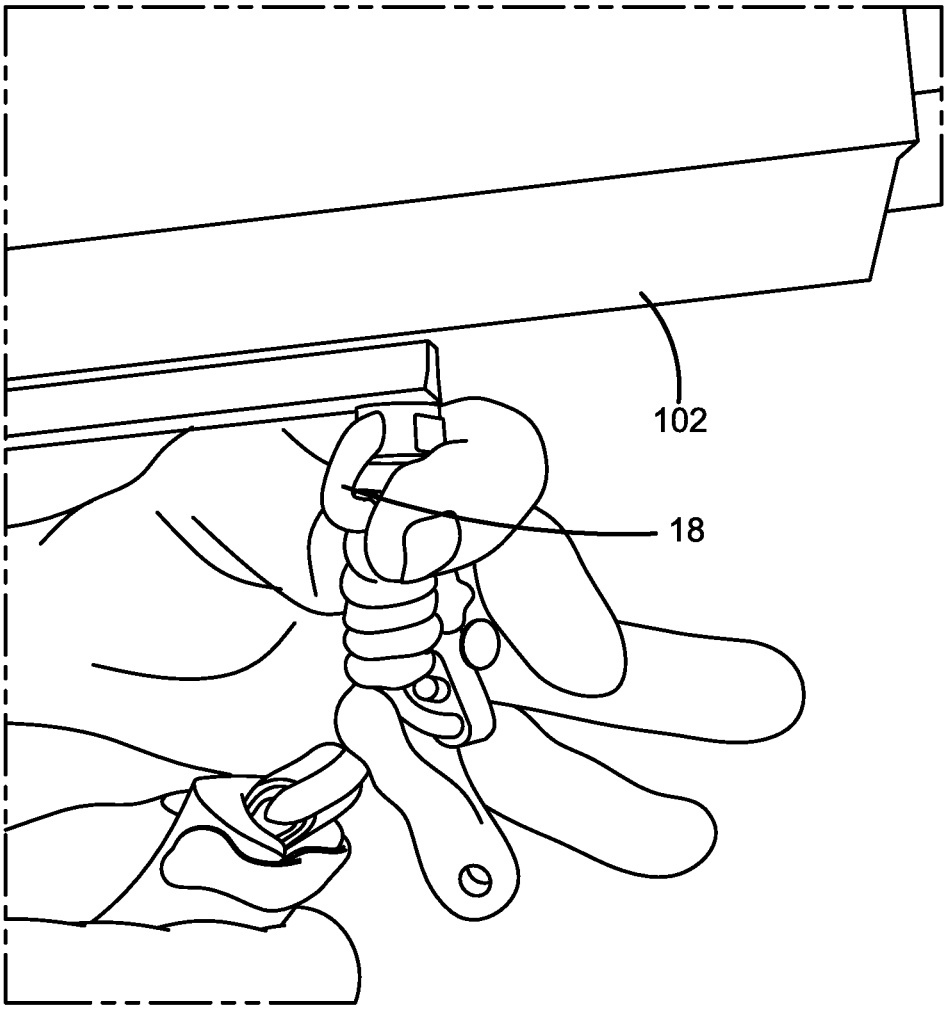
FIG. 8 is a perspective view of a first interchangeable weapon interface of an adjustable shooting strap being attached to a firearm in accordance with the present invention.
Figure 9:
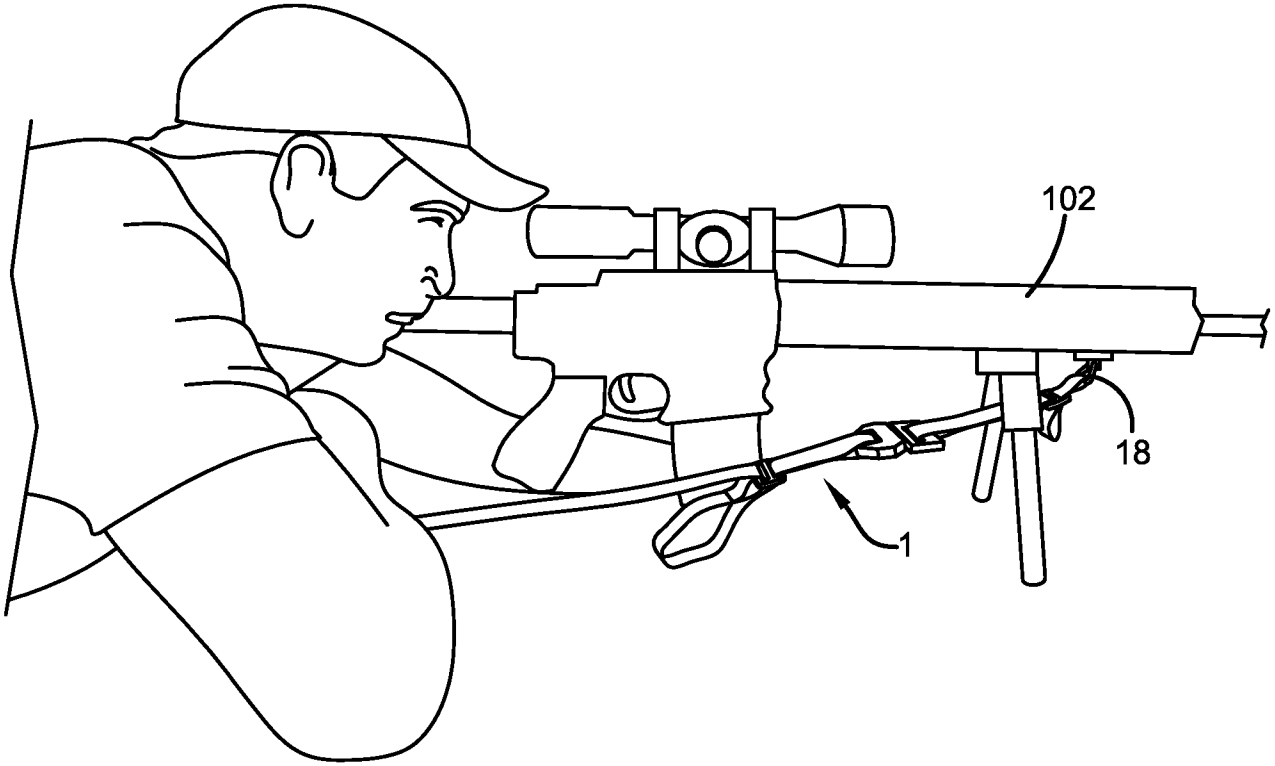
FIG. 9 is a side view of an adjustable shooting strap being in a prone position in accordance with the present invention.

With reference to FIGS. 7-9, the prone position application includes connecting the carabiner 68 to a belt 100; connecting the first interchangeable weapon interface 18 to a front of a firearm 102; pulling slack out of the lengthwise strap 36 with the cam buckle 56; and using the hand loop 52 to fine adjust tension of the lengthwise strap 36.

Figure 10:
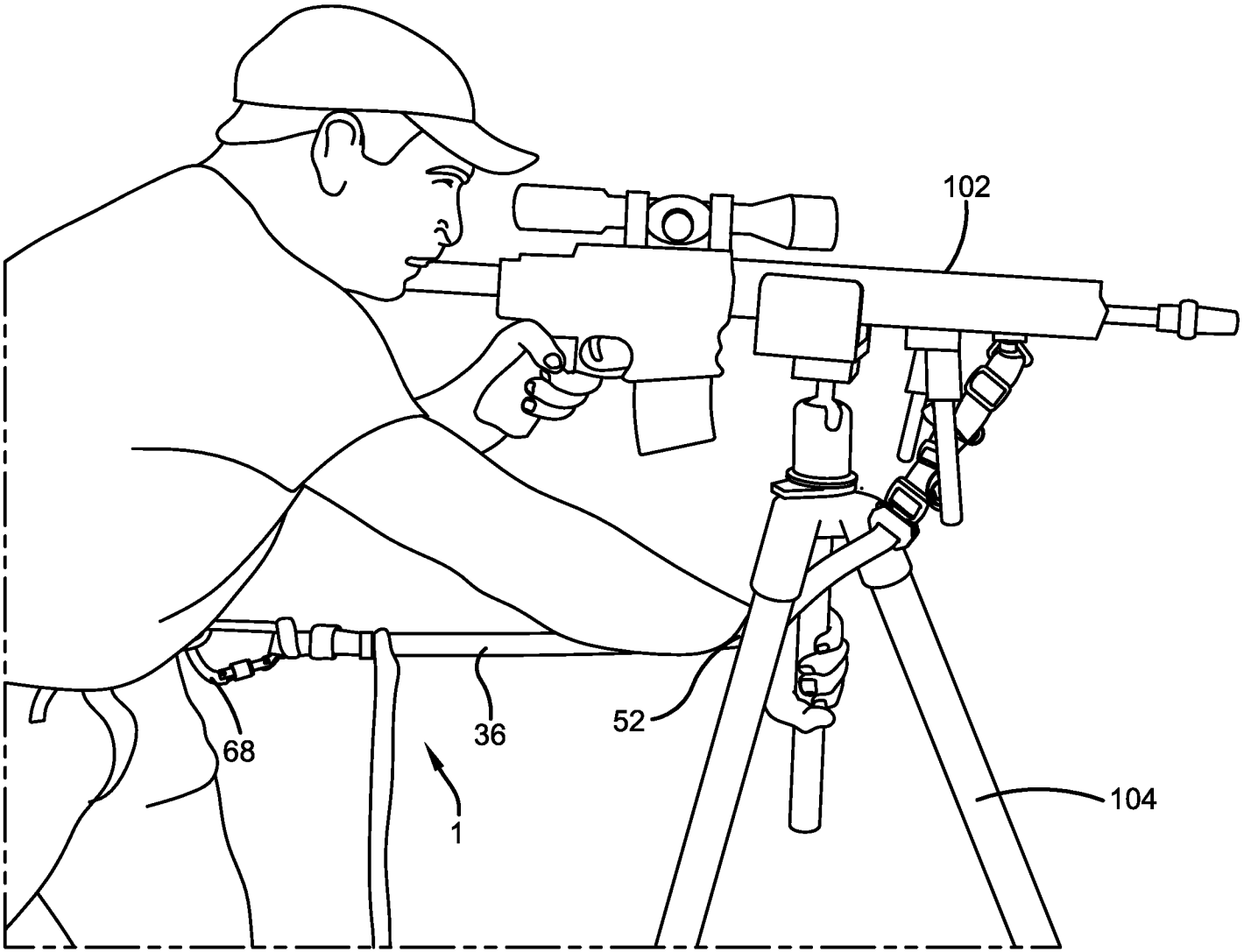
FIG. 10 is a side perspective view of an adjustable shooting strap being used with a tripod with the adjustable shooting device attached to a waist and with the user standing in accordance with the present invention.

With reference to FIG. 10, the tripod application with adjustable shooting strap 1 includes connecting the carabiner 68 to the belt 100; connecting the first interchangeable weapon interface 18 to a front of the firearm 102; attaching the firearm to a tripod 104; pulling slack out of the lengthwise strap 36 with the cam buckle 56; and using the hand loop 52 for fine adjustment.

Figure 11:
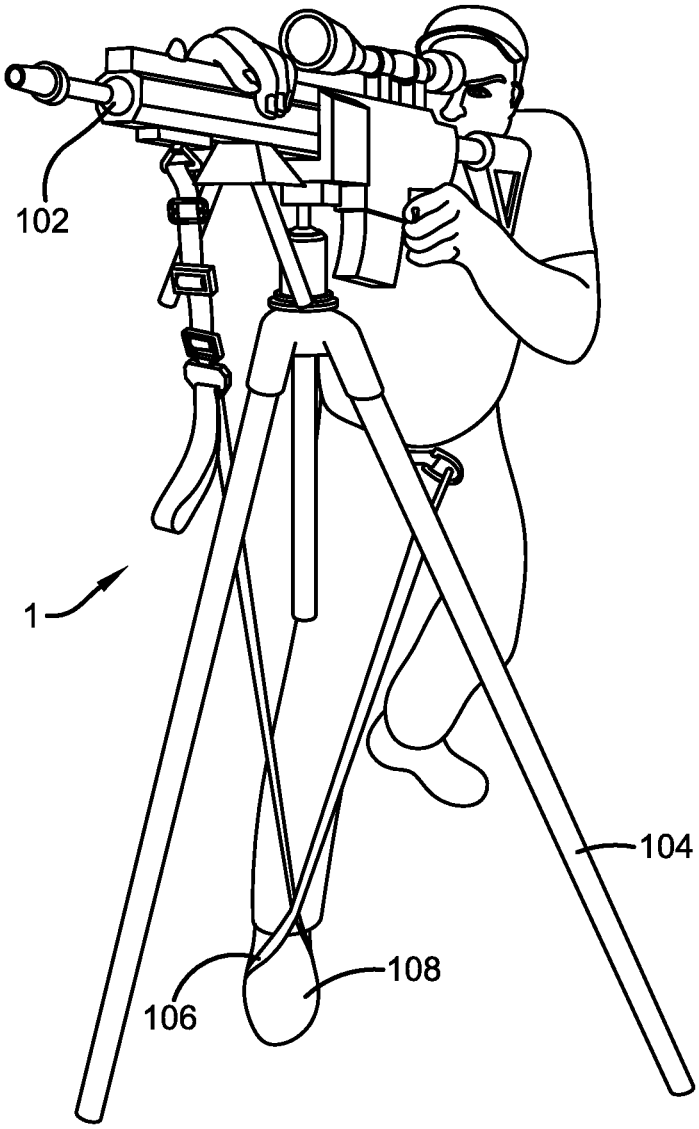
FIG. 11 is a front perspective view of an adjustable shooting strap being used with a tripod in a standing gas pedal technique in accordance with the present invention.

With reference to FIG. 11, the tripod application with standing gas pedal technique includes connecting the carabiner 68 to the belt 100; connecting the first interchangeable weapon interface 18 to the front of the firearm 102; attaching the firearm 102 to the tripod 104; removing slack from the lengthwise strap 36, such that it just touches the ground with the cam buckle 56; create a loop 106; insert a foot 108 through the loop 106 and use the hand loop 52 for fine adjustment.

Figure 12:
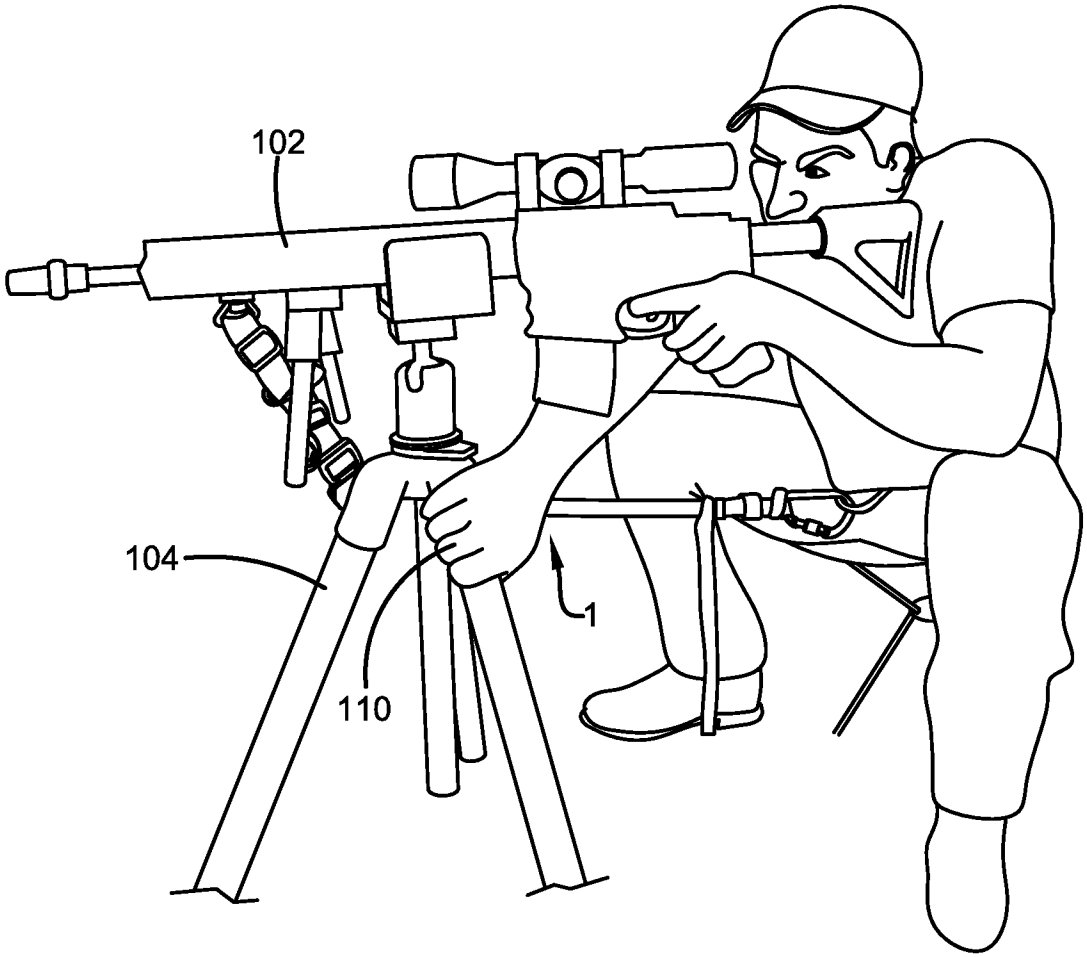
FIG. 12 is a side perspective view of an adjustable shooting strap being used with a tripod in a seated or kneeling position with the adjustable shooting strap attached to a waist in accordance with the present invention.

With reference to FIG. 12, the tripod application with adjustable shooting strap 1 attached to a waist while seated or kneeling includes connecting the carabiner 68 to the belt 102; connecting the first interchangeable weapon interface 18 to the front of a firearm 102; while sitting or kneeling remove slack from the lengthwise strap 36; use the hand loop 52 for fine adjustment; grasp the tripod 104 with a non-firing hand 110 and drop hips back to pull the firearm 102 down to the tripod 104.

Figure 13:
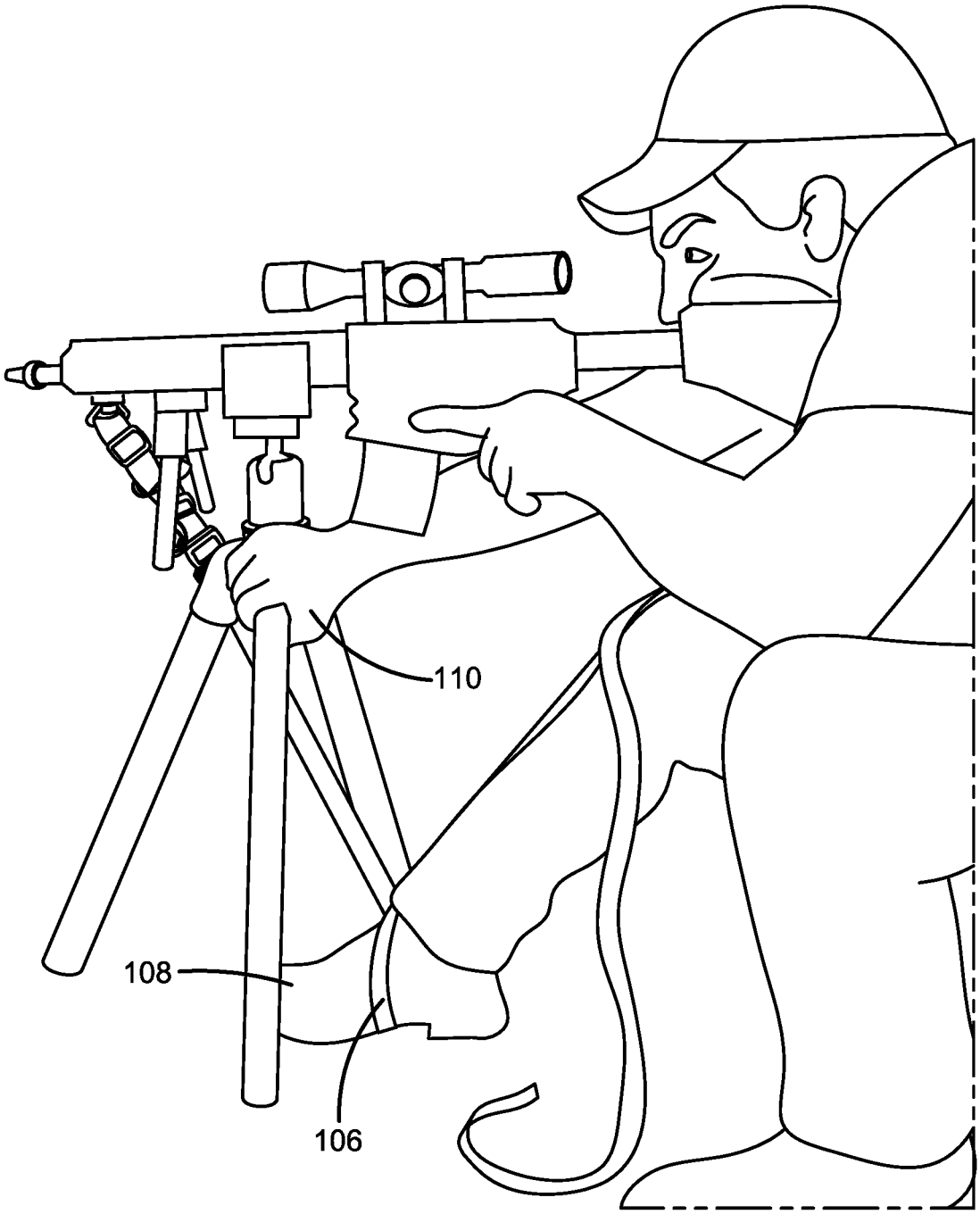
FIG. 13 is a side perspective view of an adjustable shooting strap being used with a tripod in a seated-gas pedal position in accordance with the present invention.

With reference to FIG. 13, the tripod application with seated gas pedal technique includes connecting the carabiner 68 to the belt 100; connecting the first interchangeable weapon interface 18 to the front of the firearm 102; removing slack from the lengthwise strap 36, such that it just touches the ground with the cam buckle 56; create the loop 106; insert the foot 108 through the loop 106; use the cam buckle 56 and the hand loop 52, such that the foot 108 is about 1.5 to 2.0 inches off the ground; adjust the firearm 102 to the target; drive a toe of the foot 108 down, placing tension on the loop 106; and drawing the firearm 102 down tightly.

Figure 14:
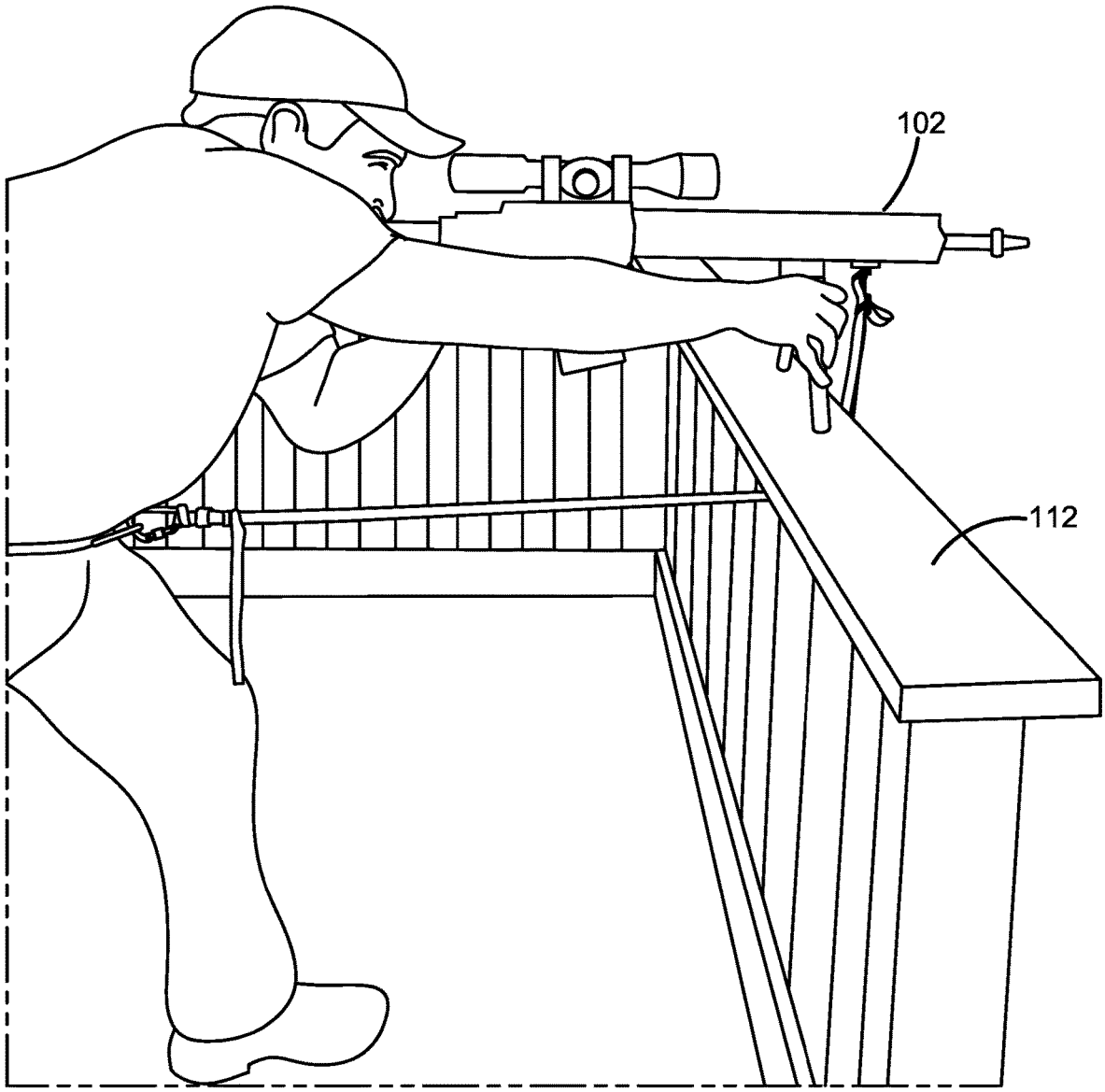
FIG. 14 is a side perspective view of an adjustable shooting strap being used in a fence/railing application in accordance with the present invention.

With reference to FIG. 14, the fence or railing application includes connecting the carabiner 68 to the belt 100; looping the lengthwise strap 36 around a fence or railing 112; connecting the first interchangeable weapon interface 18 to the front of the firearm 102; pulling slack out of the lengthwise strap 36 with the cam buckle 56 and the hand loop 52.

Figure 15:
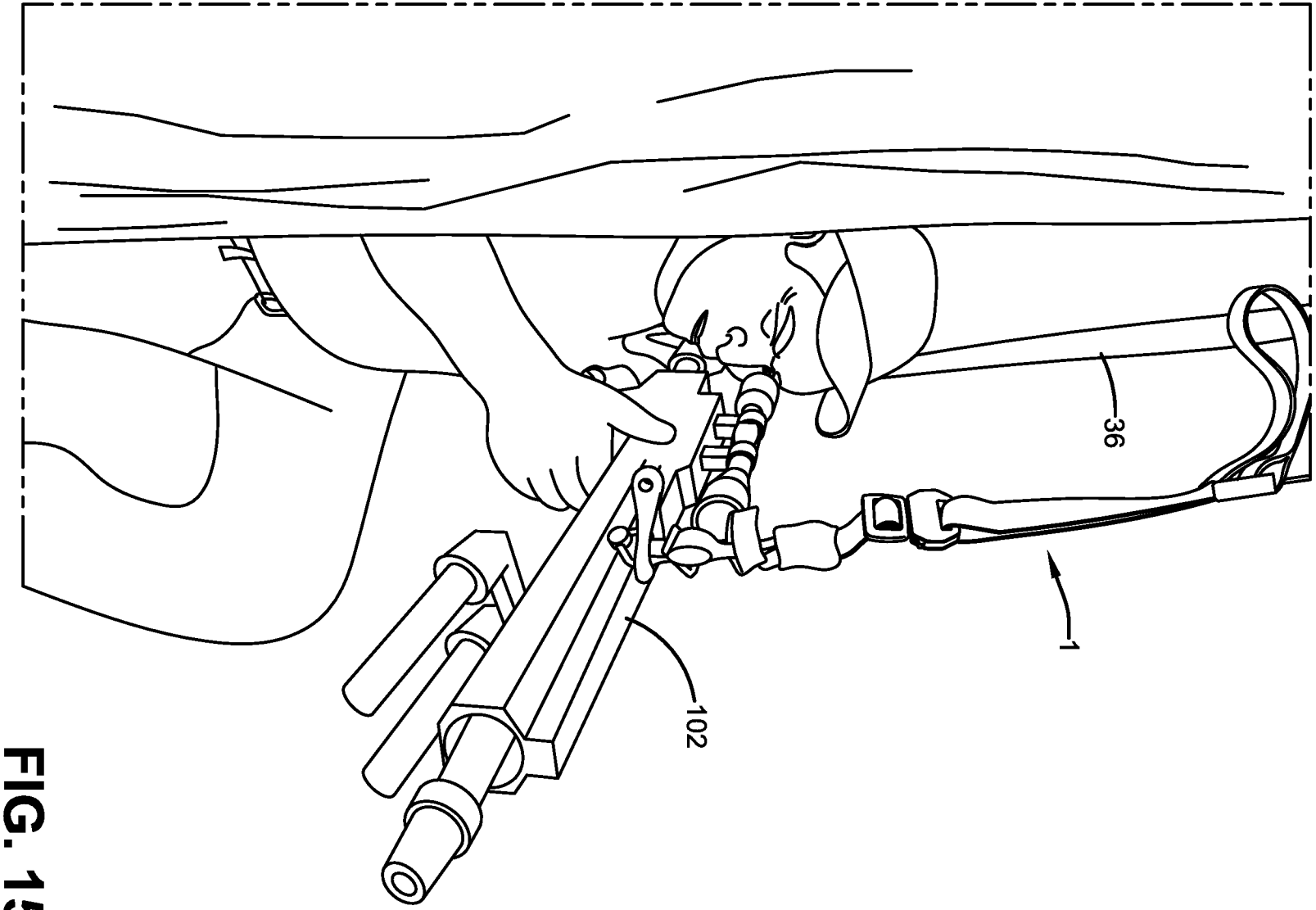
FIG. 15 is a perspective view of an adjustable shooting strap being used in an overhead suspension application in accordance with the present invention.

With reference to FIG. 15, the overhead suspension application includes wrapping the lengthwise strap 36 around an overhead object; connecting the first interchangeable weapon interface 18 to a portion of the firearm 102; connecting the carabiner 68 to the lengthwise strap 36; pulling slack out of the lengthwise strap 36 with the cam buckle 56; and using the hand loop 52 for fine adjustment.

The adjustable shooting strap may be used in other tradition alternative shooting positions, such as standing kneeling at sitting.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable shooting strap comprising:

a weapon interface section includes a weapon strap, a first interchangeable weapon interface and a male connection buckle, said first interchangeable weapon interface is retained on a first end of said weapon strap and said male connection buckle is retained on a second end of said weapon strap;

a strap section includes a lengthwise strap, a female detachable buckle, a hand loop and an adjustment buckle, said female detachable buckle is retained on a first end of said lengthwise strap, said adjustment buckle is retained on a second end of said lengthwise strap, said hand loop is created in said lengthwise strap for the adjustment of tension in said lengthwise strap, said female detachable buckle is sized to receive said male connection buckle;

a carabiner strap section includes a carabiner and a carabiner strap, said carabiner is retained on a first end of said carabiner strap, a second end of said carabiner strap is engaged with said adjustment buckle; and a fine adjustment buckle includes a first end bar, a middle fine bar and a second end bar, said lengthwise strap is slidably retained relative to said middle bar, a portion of said lengthwise strap is secured around said first end bar, said first end of said lengthwise strap is secured around said second end bar, wherein said hand loop is pulled to adjust tension on said lengthwise strap.

2. The adjustable shooting strap of claim 1 wherein:

said adjustment buckle includes a first cam loop, a second cam loop and a spring-loaded retainer, said second end of said lengthwise strap is slidably retained in said first cam loop, said second end of said carabiner strap is retained in said second cam loop, said lengthwise strap is retained in said spring-loaded retainer.

3. The adjustable shooting strap of claim 2, further comprising:

a handle extends from said spring-loaded retainer.

4. The adjustable shooting strap of claim 1, further comprising:

a first end of said weapon strap is inserted through a loop in said first interchangeable weapon interface and folded over to form a first belt loop, said first belt loop is maintained with a first buckle, said first belt loop includes a first weapon leg and a second weapon leg.

5. The adjustable shooting strap of claim 1, further comprising:

an end of a second weapon leg is inserted through a second buckle and through said male connection buckle, an end of said second weapon leg is folded over and sewn to itself to form a second belt loop to retain said male connection buckle, an end of said second weapon leg is inserted through said second buckle and through said male connection buckle.

6. An adjustable shooting strap comprising:

a weapon interface section includes a weapon strap, a first interchangeable weapon interface and a male connection buckle, said first interchangeable weapon interface is retained on a first end of said weapon strap and said male connection buckle is retained on a second end of said weapon strap;

a strap section includes a lengthwise strap, a female detachable buckle and an adjustment buckle, said female detachable buckle is retained on a first end of said lengthwise strap, said adjustment buckle is retained on a second end of said lengthwise strap, said female detachable buckle is sized to receive said male connection buckle;

a carabiner strap section includes a carabiner, a carabiner strap and a second weapon interface, said carabiner is retained on a first end of said carabiner strap, a second end of said carabiner strap is engaged with said adjustment buckle, said second weapon interface is retained on a second end of said carabiner strap; and a second end of said carabiner strap is inserted through a second weapon buckle and a loop of said second weapon interface, said second end of said carabiner strap is folded over said loop of said second weapon interface and re-inserted through said second weapon buckle.

7. The adjustable shooting strap of claim 6, wherein:

said adjustment buckle includes a first cam loop, a second cam loop and a spring-loaded retainer, said second end of said lengthwise strap is slidably retained in said first cam loop, said second end of said carabiner strap is retained in said second cam loop, said lengthwise strap is retained in said spring-loaded retainer.

8. The adjustable shooting strap of claim 7, further comprising:

a handle extends from said spring-loaded retainer.

9. The adjustable shooting strap of claim 6, further comprising:

a first end of said weapon strap is inserted through a loop in said first interchangeable weapon interface and folded over to form a first belt loop, said first belt loop is maintained with a first buckle, said first belt loop includes a first weapon leg and a second weapon leg.

10. The adjustable shooting strap of claim 6, further comprising:

an end of a second weapon leg is inserted through a second buckle and through said male connection buckle, an end of said second weapon leg is folded over and sewn to itself to form a second belt loop to retain said male connection buckle, an end of said second weapon leg is inserted through said second buckle and through said male connection buckle.

* * * * *